US008096856B2

(12) United States Patent
Zaiser et al.

(10) Patent No.: US 8,096,856 B2
(45) Date of Patent: Jan. 17, 2012

(54) MOTOR-DRIVEN MACHINE TOOL

(75) Inventors: Adolf Zaiser, Koengen (DE); Jens Blum, Filderstadt (DE); Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 380 days.

(21) Appl. No.: 12/374,693

(22) PCT Filed: Feb. 19, 2008

(86) PCT No.: PCT/EP2008/052011

§ 371 (c)(1),
(2), (4) Date: Jan. 22, 2009

(87) PCT Pub. No.: WO2008/128802

PCT Pub. Date: Oct. 30, 2008

(65) Prior Publication Data

US 2010/0003906 A1 Jan. 7, 2010

(30) Foreign Application Priority Data

Apr. 19, 2007 (DE) ..... 10 2007 018 465

(51) Int. Cl.
*B24B 23/04* (2006.01)

(52) U.S. Cl. ..... 451/357; 451/163

(58) Field of Classification Search ..... 451/357, 451/359, 159, 163
See application file for complete search history.

(56) References Cited

U.S. PATENT DOCUMENTS

| | | | | |
|---|---|---|---|---|
| 1,464,351 | A | 8/1923 | Casey | |
| 2,350,098 | A * | 5/1944 | Decker | 451/356 |
| 2,671,476 | A | 3/1954 | Richards et al. | |
| 4,145,086 | A | 3/1979 | Ishihara | |
| 4,242,839 | A * | 1/1981 | Armbruster et al. | 451/357 |
| 4,787,430 | A | 11/1988 | Miyamoto | |
| 5,482,499 | A * | 1/1996 | Satoh | 451/356 |
| 5,856,715 | A | 1/1999 | Peot et al. | |
| 7,291,061 | B2 | 11/2007 | Kiss | |
| 2003/0220058 | A1 * | 11/2003 | Pollak et al. | 451/357 |
| 2008/0190259 | A1 | 8/2008 | Bohne | |

FOREIGN PATENT DOCUMENTS

| | | |
|---|---|---|
| CH | 685 154 | 4/1995 |
| DE | 27 06 187 | 8/1977 |
| DE | 42 03 890 | 10/1992 |
| DE | 10 2004 047 811 | 3/2006 |
| DE | 10 2004 047 812 | 3/2006 |
| DE | 10 2004 050 798 | 4/2006 |
| EP | 0 829 237 | 3/1998 |
| GB | 2 419 559 | 5/2006 |
| JP | 52-18282 | 2/1977 |

* cited by examiner

*Primary Examiner* — Robert Rose
(74) *Attorney, Agent, or Firm* — Michael J. Striker

(57) ABSTRACT

A motor-driven machine tool (1) with a tool (7) that can be rotatably driven comprises a drive shaft (5) and a driven shaft (6) on which the tool (7) is received, the rotational movement of the drive shaft (5) being transmissible onto the driven shaft (6) via a coupling device (8). The drive shaft and the driven shaft are arranged in parallel, the driven shaft (6) extending at least partially at the level of and parallel to the drive unit.

4 Claims, 2 Drawing Sheets

MOTOR-DRIVEN MACHINE TOOL

Figure 1:
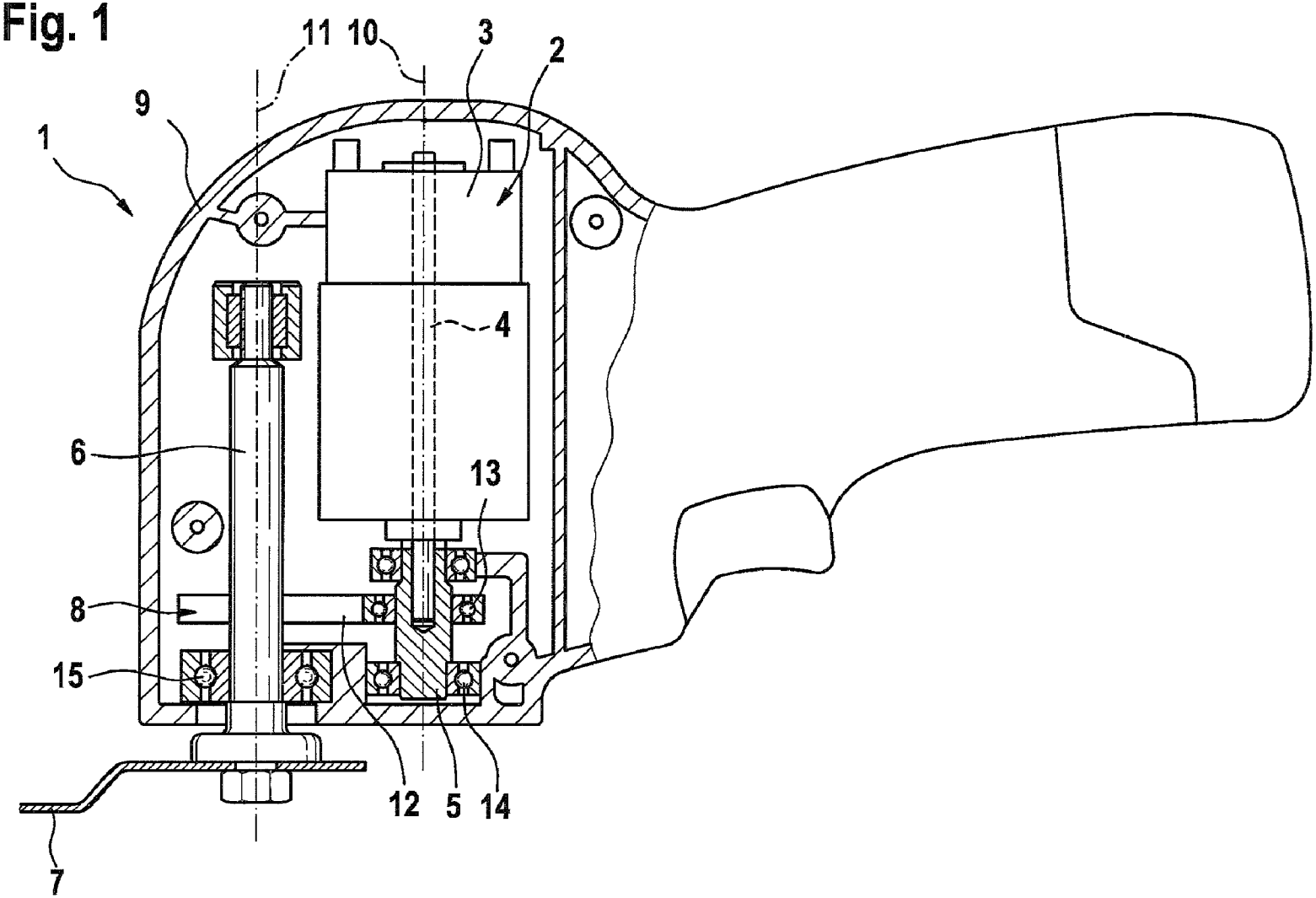

The present invention relates to a motor-driven machine tool which includes a drive shaft which is driven by a drive unit, and an output shaft on which the tool is installed, according to the preamble of claim 1.

BACKGROUND INFORMATION

DE 10 2004 050 798 A1 describes a hand-held power tool with a working shaft which may be driven in an oscillating manner, and on which a tool is installed; the oscillating drive results in a rotational pendulum motion of the tool which may be used for grinding or cutting. The working shaft and/or tool shaft on which the tool is installed is driven by a rotatably connected arm which interacts, as part of an eccentric coupling device, with an eccentric disk which is driven by an electric motor.

DISCLOSURE OF THE INVENTION

Based on this prior art, the object of the present invention is to provide a compact, motor-driven machine tool having a rotatably driveable tool.

This object is achieved according to the present invention having the features of claim 1. The dependent claims describe expedient developments.

The motor-driven machine tool—which is a hand-held power tool in particular, the tool of which carries out a rotational motion, in particular a rotational pendulum motion—includes drive shafts and output shafts which are situated parallel to one another. It is also provided that the output shaft extends at least partially at the level of and parallel to the drive unit. In this manner it is ensured that the output shaft, with the tool installed thereon, is located directly next to the drive unit, including the drive shaft which belongs to the drive unit, the machine tool being short in design in the axial direction and therefore requiring little installation space, given that the output shaft and the drive unit overlap axially. The same applies for the direction transversely to the shafts, since the amount of space required by parallel configuration of the output shaft in the transverse direction is not much greater than that required by the drive unit.

A further advantage of the parallel configuration is that the transfer of motion between the drive shaft and the output shaft may be carried out without play, or at least with reduced play, since the rotational axes are parallel. In particular, it is possible for the components included in the coupling device between the drive shaft and the output shaft to bear against one another in a linear or two-dimensional manner; a punctiform transfer of force, which occurs, e.g. in the prior art in the case of shafts which are situated at angles to one another, and which includes local, high force loads with the risk of increased play, may be prevented.

The linear or two-dimensional contact of the participating components with the coupling device is suited, in particular, for use with an eccentric coupling device for transferring a rotational pendulum motion from the rotating drive shaft to the output shaft on which the tool is mounted. This eccentric coupling device includes a coupling member and an eccentric member, which are situated on different shafts, the coupling member preferably being situated on the output shaft, and the eccentric member advantageously being situated on the drive shaft. The rotational motion of the rotating eccentric member is coverted via the coupling member into the rotational pendulum motion of the output shaft. Due to the parallel configuration of the drive shaft and output shaft, it is possible to realize a linear or two-dimensional contact between the coupling member and the eccentric member.

For this purpose, the eccentric member is expediently designed as an eccentric cam, the contour of which is followed by the coupling member. The coupling member is fork-shaped in design, for example, the two fork tines enclosing the eccentric member. The two-dimensional or linear contact between the coupling member and the eccentric member takes place, in particular, via the semicircular or circular design of the contours—which bear against one another—of the two components. The linear or two-dimensional contact makes it possible to better distribute the forces to be transferred, thereby decreasing the punctiform load.

According to a further advantageous embodiment, one component of the coupling device is located adjacent to the tool on the output shaft. It is also expedient to design the drive unit as an electric motor and to locate the stator of the electric motor on the side facing away from the tool, in the housing of the machine tool. The positioning of the coupling device on the side facing away from the tool makes possible a short design of the output shaft, which is further supported by the fact that the drive shaft is also located on the side facing the tool and is acted upon in a rotational manner by the drive unit. The length of the installation space in the axial direction is determined primarily by the drive unit, i.e. by the electric motor.

Further advantages and expedient embodiments are depicted in the further claims, the description of the figures, and the drawings.

Figures 2, 3:
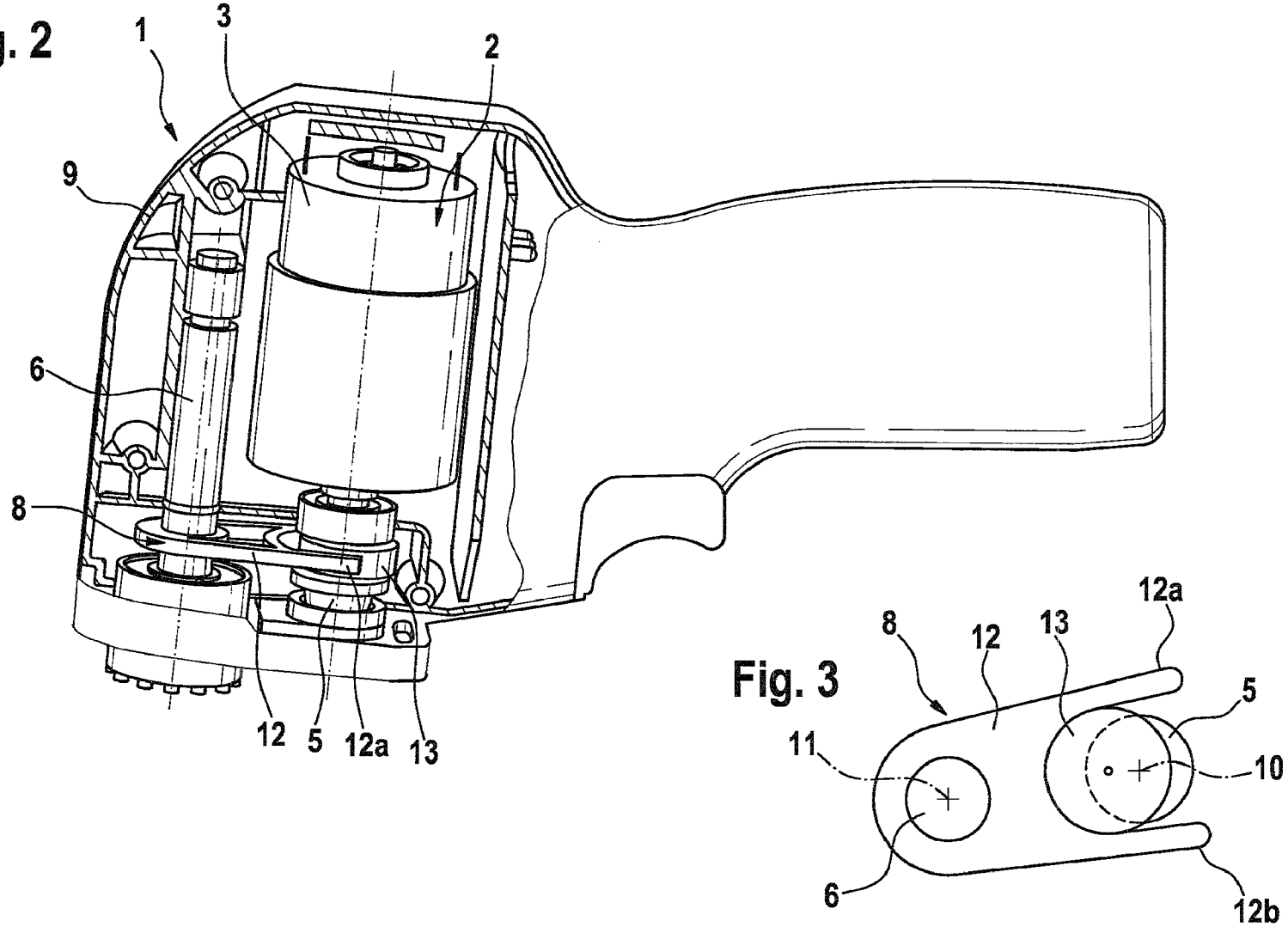

FIG. 1 shows a sectional view through the hand-held power tool, the tool of which carries out an oscillating rotational and pendulum motion for sawing and/or grinding, the tool being held on an output shaft which is parallel to a drive shaft which is driven by an electric motor, FIG. 2 shows the hand-held power tool in a perspective view, FIG. 3 shows the eccentric coupling device in an isolated view, via which the rotational motion of the drive shaft—which is drive by an electric motor—is converted into the rotational pendulum motion of the output shaft on which the tool is installed.

Components that are the same are labelled with the same reference numerals in the figures.

Hand-held power tool 1 shown in FIG. 1 includes an electric drive motor 2 in a housing 9, electric drive motor 2 being composed of a stator 3 which is fixedly mounted in the housing 9, and an armature or rotor 4, on which a drive shaft 5 is situated in a non-rotatable, coaxial manner. The rotational motion of drive shaft 5 is transferred via an eccentric coupling device 8 to an output shaft 6 on which a tool 7 is installed. Via eccentric coupling device 8, the rotational motion of drive shaft 5 is converted to a rotational pendulum motion of output shaft 6.

Drive shaft 5 and output shaft 6 and, therefore, particular rotational axes 10 and 11 are situated parallel to one another in housing 9. To obtain a device which is compact in the axial direction, output shaft 6 extends—as viewed in the axial direction—to the level of stator 3 of electric drive motor 2. The result is a partial overlap of output shaft 6 and stator 3 in the axial direction. The end face of output shaft 6 on which tool 7 is installed extends slightly out of housing 9 in the axial direction. As viewed in the axial direction, output shaft 6 overlaps stator 3 by approximately half its length.

The eccentric coupling device is composed of a coupling fork 12 which is non-rotatably connected to output shaft 6, and an eccentric cam 13 which is non-rotatably connected to drive shaft 5. Coupling fork 12 bears against the contour of eccentric cam 13, thereby making it possible for the motion of eccentric cam 13—which is eccentric relative to rotational axis 10 of drive shaft 5—to be followed by coupling fork 12 and converted to an oscillating pendulum motion about rotational axis 11 of output shaft 6. Eccentric coupling device 8 is adjacent to pivot bearings 14 and 15, via which drive shaft 5 and output shaft 6 are rotatably supported in housing 9 on their end faces which face tool 7. The components of eccentric coupling device 8, that is, coupling fork 12 and eccentric cam 13, are therefore located adjacent to the end face of the particular shafts which faces tool 7.

As shown in FIG. 2 and, in particular, FIG. 3, coupling fork 12 includes—as a component of eccentric coupling device 8—two fork tines 12*a* and 12*b* which enclose the contour of eccentric cam 13. The section between fork tines 12*a* and 12*b* is expediently semicircular in design and adapted to the circular shape of eccentric cam 13, thereby ensuring that coupling fork 12 and the outer contour of eccentric cam 13 bear against one another in a two-dimensional manner across an angular section.

What is claimed is:

1. A motor-driven machine tool (1) with a housing (9), the tool comprising a rotatably driveable tool (7), a drive shaft (5) which is driven by a drive unit (2), and an output shaft (6) on which the tool (7) is mounted, wherein the rotational motion of the drive shaft (5) is transferred via an eccentric coupling device (8) to the output shaft (6), wherein the drive shaft (5) and the output shaft (6) are situated parallel to one another, the output shaft (6) extending at least partially at the level of and parallel to the drive shaft (5), wherein the eccentric coupling device (8) includes an eccentric member (13) operatively connected to a coupling member (12), which coupling member (12) is fixedly mounted on the output shaft (6), adjacent to tool (7), to convert the rotational motion of the drive shaft (5) to a pendulum motion of the output shaft (6), wherein the drive unit (2) is designed as an electric motor comprising a stator (3) situated on a side of the output shaft (6) facing away from the tool (7) within the housing (9), and wherein over half of an axial length of the output shaft (6) overlaps the stator (3).

2. The machine tool as recited in claim 1, wherein the eccentric member is designed as an eccentric cam (13) which is fixedly connected to the drive shaft (5), and wherein the coupling member (12) bears against the contour of the eccentric cam (13).

3. The machine tool as recited in claim 1, wherein the coupling member (12) has a fork with fork tines (12*a*, 12*b*) enclosing the eccentric member (13).

4. The machine tool as recited in claim 2, wherein the eccentric cam (13) and a section of the coupling member (12) which bears against the eccentric cam each have an at least semicircular contour and bear against each other in an at least approximately linear or two-dimensional manner.

* * * * *